United States Patent [19]

Thomas, Jr.

[11] 4,211,198

[45] Jul. 8, 1980

[54] AIR/FUEL MIXING ARRANGEMENT FOR AN INTERNAL COMBUSTION ENGINE

[75] Inventor: Charles W. Thomas, Jr., Flatwoods, Ky.

[73] Assignee: Leonard Furman, Bexley, Ohio ; a part interest

[21] Appl. No.: 922,054

[22] Filed: Jul. 5, 1978

[51] Int. Cl.[2] ..... F02M 17/18

[52] U.S. Cl. ..... 123/592; 261/121 A

[58] Field of Search ..... 123/141, 133, 127, 120, 123/121, 136; 261/35, 87, 88, 121 A

[56] References Cited

U.S. PATENT DOCUMENTS

| | | | |
|---|---|---|---|
| 1,153,077 | 9/1915 | Hippel | 123/141 |
| 2,742,886 | 4/1956 | McPherson | 123/133 |
| 2,746,440 | 5/1956 | Eriksen | 123/133 |
| 3,199,847 | 8/1965 | Wahnish | 261/35 |
| 3,655,169 | 4/1972 | Goldsarb | 261/35 |
| 4,001,077 | 1/1977 | Kemper | 261/35 |

*Primary Examiner*—Ronald H. Lazarus

*Attorney, Agent, or Firm*—Cushman, Darby & Cushman

[57] ABSTRACT

An impeller is secured to one end of a hollow shaft and is positioned within a chamber to which air is supplied. An output line from the chamber is joined with the intake manifold of an engine. The opposite end of the hollow shaft is immersed in fuel. When a vacuum is drawn by the manifold, air flow through the chamber rotates the impeller while fuel is simultaneously drawn through the shaft and discharged into the chamber. The turbulence and agitation of the impeller atomizes the fuel so that an air/fuel mixture is supplied to the manifold through the output line. Pressurized air is applied to the fuel as it rises in the hollow shaft to provide initial fuel atomization.

9 Claims, 4 Drawing Figures

AIR/FUEL MIXING ARRANGEMENT FOR AN INTERNAL COMBUSTION ENGINE

The present invention relates to an air/fuel mixing arrangement for an internal combustion engine which eliminates the requirement of a conventional carburetor.

BACKGROUND OF THE INVENTION

In conventional internal combustion engines, the air/fuel mixture for combustion is supplied by a carburetor. Such a device is a complex apparatus which requires frequent maintenance attention in order for it to operate properly.

Carburetors also suffer disadvantages in efficiency in providing volumetric throughputs of an air/fuel mixture sufficient to provide adequate power for high speed driving. A number of attempts to improve carburetor efficiency have been made. Generally speaking, these efforts have centered around devices placed between the carburetor and the intake manifold to accomplish additional agitation of the carbureted fuel prior to its passage into the intake manifold. One approach which previously has been taken introduces a rotatable turbulence producing means between the carburetor and the intake manifold. The general configuration of such a device approximates the shape of a fan-type impeller. With such an arrangement, the speed of rotation of the impeller, and hence the amount of turbulence produced, is directly dependent upon the volumetric throughput of the carbureted air/fuel mixture. Thus, at higher speeds and engine power requirements where the volumetric throughput is greater, the speed of rotation of the impeller is greater and, correspondingly, greater turbulence and mixing of the air and fuel are provided. On the other hand, at lower speeds and engine power requirements, the volumetric throughput of the air/fuel mixture is less and, accordingly, the turbulence and mixing of the air/fuel mix produced by the impeller are less. In other words, the rotatable impeller inherently adjusts in speed of rotation whereby it corresponds to engine speed and power requirements.

However, the known impeller device just described suffers an important disadvantage. While it is capable of intimately mixing already vaporized fuel with carbureted air, it is not capable of significantly atomizing liquid fuel droplets by itself. Consequently, the use of such a turbulence producing device heretofore has been restricted to its being combined with a conventional carburetor whereby the efficiency of the latter is improved by agitation of the air/fuel mixture produced by the carburetor.

OBJECTS OF THE INVENTION

The principal object of the present invention is to take advantage of the simplicity and air/fuel mixing characteristics of a turbulence producing device while simultaneously eliminating the need for a costly, complex and inefficient conventional carburetor.

It is a further object of the invention to provide an air/fuel arrangement which is responsive to varying engine speed and power requirements in order to provide a proper air/fuel mixture to the engine.

BRIEF DESCRIPTION OF THE INVENTION

The present invention provides an impeller device housed in a chamber to which air is supplied and from which an air/fuel mixture is withdrawn. The impeller is mounted at the end of a rotatable hollow shaft having its opposite end immersed in a fuel storage container. As the impeller rotates, fuel is drawn through the hollow cylinder and is ejected adjacent the impeller blades in order to be atomized and mixed with air supplied to the chamber. In its passage through the hollow shaft, pressurized air is directed into the flow path in order to initially atomize the fuel prior to its being further atomized by the impeller. Means also are provided to selectively pass fuel directly from the storage container to the intake manifold of the engine so as to provide a rich air/fuel mix when the engine is cold.

The invention now will be described in further detail with reference to the accompanying drawings.

DETAILED DESCRIPTION OF THE INVENTION

Figure 1:
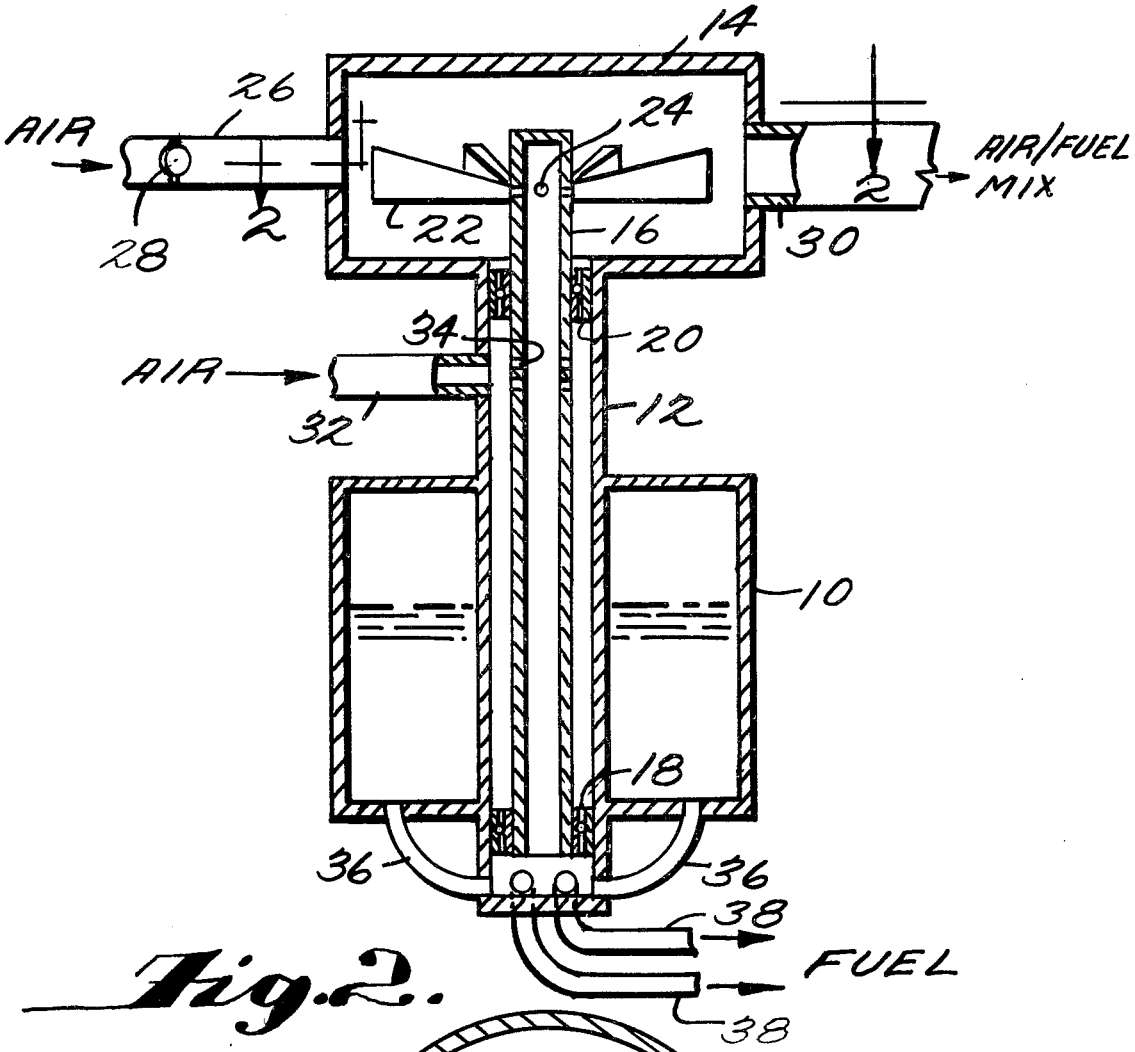
FIG. 1 is a side elevational view, partially in section, illustrating the arrangement for producing an air/fuel mixture in accordance with the present invention.
Figure 2:
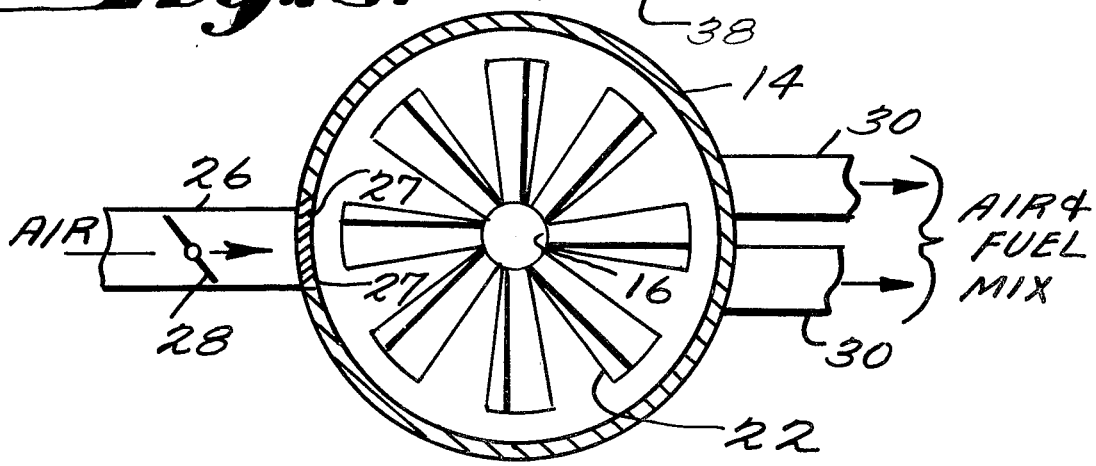
FIG. 2 is a sectional view taken along line 2—2 of FIG. 1.

Referring to FIGS. 1 and 2, the arrangement for producing an air/fuel mixture will be described.

Fuel is stored in a container 10. A cylindrical column 12 projects through the container from a level below to a location above the container. Although the cylinder 12 is shown as integrally formed in conjunction with the container, it is apparent that they may comprise separate components with suitable seals provided at the locations where the cylinder 12 passes through the bottom and top walls of the container. A chamber 14 is provided at the upper end of cylinder 12. A hollow shaft 16 having a closed upper end is positioned within the cylinder 12 and chamber 14. Shaft 16 is retained in position and allowed to rotate with respect to cylinder 12 by suitable bearings 18 and 20. An impeller 22 is secured to the upper end of shaft 16. The impeller comprises a plurality of radially spaced blades and serves as a rotatable turbulence producing means. A plurality of openings 24 are provided in shaft 16 at radially spaced locations disposed between the intersections of the impeller blades with the shaft. An air intake line 26 is connected to one side of chamber 14. At the area of the connection, suitable vanes 27 are provided to direct air flow past the vanes against the impeller blades. A butterfly valve 28 is provided in line 26 to control the amount of air which is permitted to be introduced into the chamber. On the opposite side of chamber 14 from the intake line 26, a suitable number of additional lines 30 are provided for carrying the air/fuel mixture to the intake manifold of the engine. In the embodiment illustrated, two such lines 30 are employed. Intermediate chamber 14 and container 12, an additional air line 32 is joined to cylinder 12. The rotatable shaft 16 is provided with a plurality of apertures 34 in alignment with line 32 for a reason which will become apparent hereinafter. A pair of fuel lines 36 interconnect the container 10 with the bottom portion of cylinder 12 whereby fuel is fed to the cylinder by gravity. An additional pair of fuel lines 38 are provided to feed fuel from the cylinder 12 to the intake manifold.

Figure 3:
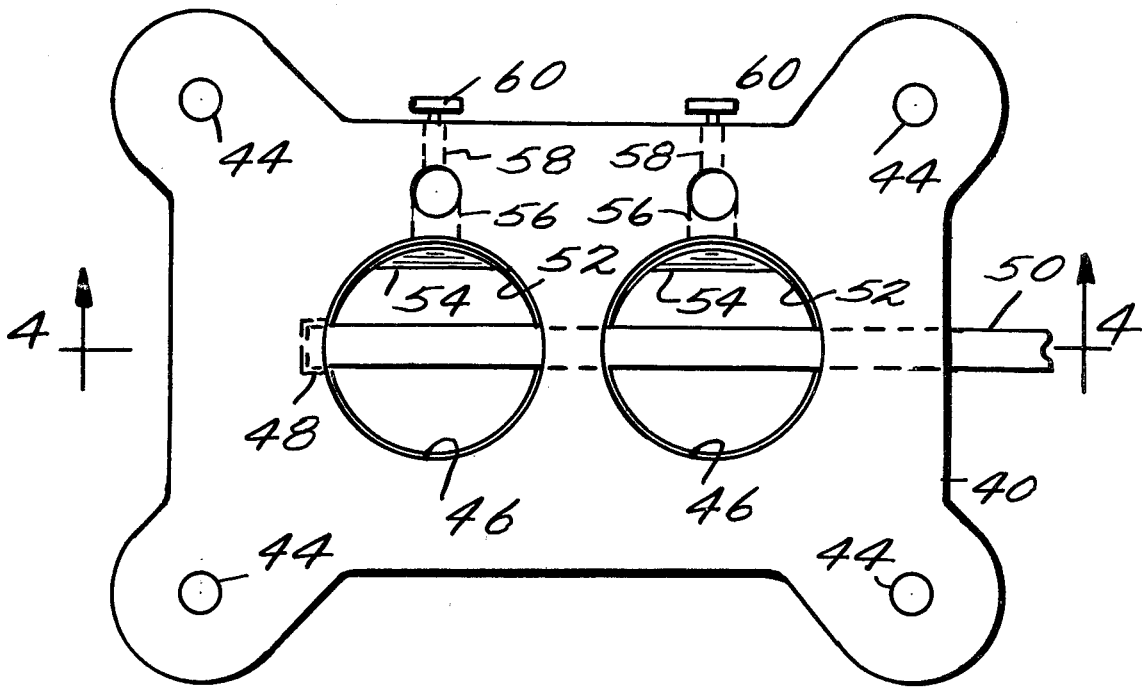
FIG. 3 is a top plan view of an adapter for introducing the air/fuel mixture to the manifold of an internal combustion engine.
Figure 4:
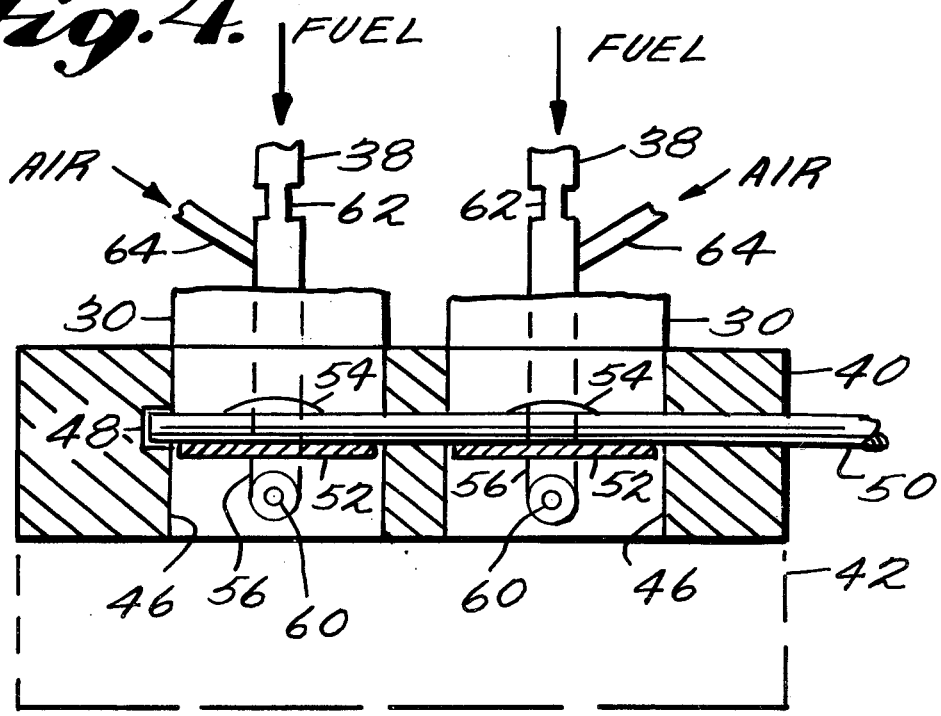
FIG. 4 is a sectional view taken along line 4—4 of FIG. 3.

Referring now to FIGS. 3 and 4, an adapter 40 is provided to fit over the conventional input manifold of an internal combustion engine (indicated generally by numeral 42 in FIG. 4). The adapter comprises a casting having suitable apertures 44 to permit the adapter to be fastened to the engine. An additional pair of apertures 46 are provided in the central portion of adapter 40. The apertures 46 permit the air/fuel mixture carried by lines 30 to pass to the intake manifold as can be appreciated from FIG. 4. The casting 40 is provided with a passage 48 which intersects the apertures 46. This passage receives a throttle rod. A pair of throttle plates 52 are secured to rod 50 within the respective apertures 46. This arrangement permits the openings to the manifold to be varied in response to rotation of rod 50 about its longitudinal axis. An edge 54 of each plate 52 is turned back at an angle of approximately 35° from the plane of the valve for a reasons to be explained subsequently. The casting 40 also is provided with a pair of L-shaped passages 56 extending from the top surface of the casting to a location within the apertures 46 at a level below that of the plates 52 when the latter extend fully across the apertures. The sides of the casting include still further passages 58 intersecting the passages 56. Passages 58 are adapted to receive conventional needle valves 60 which are operative to control the openings of passages 56. The fuel lines 38 are joined to passages 56 at the upper surface of casting 40. Upstream of passages 56 the lines 38 are provided with constrictions 62, and downstream of the constrictions additional lines 64 are provided. The lines 64 serve as breathers to introduce air to the fuel supplied by lines 38.

The structure of the air/fuel mixing arrangement having been outlined, its manner of operation now will be described.

With the engine cold, as in the starting position, the throttle plates 52 are in the position shown in FIGS. 3 and 4 effectively closing apertures 46. Fuel from container 10 passes through lines 38 to be mixed with air supplied by the breather lines 64 and then supplied to the engine intake manifold via passages 56. This mixture is one having a high fuel-to-air ratio. Consequently, the engine is supplied with a rich mixture to facilitate starting.

As the engine starts and idles, a small vacuum is developed in the manifold which draws additional air through the breather lines 64. Since constrictions 62 are provided in lines 38 upstream of the locations of lines 64, passage of fuel through lines 38 is impeded. Therefore, the manifold's vacuum is not as effective in drawing fuel via lines 38 as it is in drawing additional air from lines 64. As a result, the mixture becomes less rich than during starting. The proper supply of the air/fuel mixture for idling is established by selective adjustment of needle valves 60.

When the engine is accelerated by actuation of the throttle, the throttle rod 50 is rotated about its axis to displace throttle plates 52 from the position shown in FIGS. 3 and 4 thereby opening apertures 46. Simultaneously, the butterfly valve 28 is opened due to a linkage (not shown) with the throttle rod operation. The opening of the air intake line 26 due to movement of valve 28 causes air to be drawn by the manifold's vacuum through line 26 and chamber 14. The vacuum also draws fuel upwardly through the hollow shaft 16. As the fuel passes apertures 34, pressurized air supplied through line 32 atomizes the fuel. The source of pressurized air is not illustrated. However, it is apparent that a number of conventional engine-operated arrangements may be employed to supply pressurized air to line 32. Movement of air through chamber 14 causes the impeller 22 and shaft 16 to rotate. Consequently, as the atomized fuel is discharged from the shaft through apertures 24, the additional turbulence and agitation caused by the blades of impeller 22 further atomizes the fuel. The air/fuel mixture is drawn by the vacuum through lines 30 and the apertures 46 into the manifold.

During the operation just described, the turned back edges 54 of the throttle plates 52 deflect the air flow path through apertures 46 thereby reducing the effect of the vacuum on the lines 38. Consequently, the supply of an air/fuel mixture to the manifold via passages 56 is effectively interrupted until such time as the throttle plates 52 are returned to the positions occupied during idling.

By appropriately relating the opening of the butterfly valve 28 with the opening of throttle plates 52, it is possible to achieve a proper air/fuel mixture for the various operating conditions of the engine.

The turbulence producing means, i.e., the impeller 22, which provides improved mixing of atomized fuel and air, may be constructed from a variety of materials such as nylon. Preferably, the pitch of the impeller blades is between about 10 and 25 degrees but can vary across the blade, as is well known in the fan art. The flow of air through the chamber 14 causes the impeller to turn at an angular speed directly proportional to the volumetric throughput of air. Therefore, the turbulence created by the impeller is also directly proportional to the volumetric throughput.

With impeller devices, in the area of the rotational axis an exceptionally strong suction is created, as compared to the suction created towards the outer portions of the impeller blades. This suction helps to draw fuel from container 10 and contributes to the turbulence within chamber 14.

From the foregoing discussion it is apparent that an appropriate air/fuel mixture can be supplied to an internal combustion engine without the necessity of a conventional carburetor. Such an arrangement is simple, efficient and economical, and it is not subject to the maintenance attention required by carburetor-type fuel supply systems.

What is claimed is:

1. An air/fuel mixing arrangement for an internal combustion engine comprising:

a fuel storage container;

a rotatably mounted hollow shaft oriented to have an open lower end positioned within said container;

an impeller secured to an upper end of the shaft for rotation therewith, said impeller including a plurality of blades radially disposed with respect to the shaft in proximity to radially arranged openings provided in the shaft;

a chamber for housing said impeller;

means for introducing air within the chamber, said means being oriented to cause the air to be directed towards the impeller blades;

an adapter joined to said internal combustion engine;

a throttle plate positioned within an aperture in said adapter, said throttle plate being selectively movable to vary the effective opening of said aperture; and passage means connecting the chamber and the aperture whereby in response to the positioning of the throttle to open said aperture, fuel is drawn from the lower end of the shaft, is atomized within the shaft by said pressurized air and then is passed through the openings in the shaft so as to be mixed by the impeller with the air introduced within the chamber, the mixture being transported to said engine via the passage means and the adapter.

2. An arrangement as set forth in claim 1, further comprising:

valve means operatively related to said throttle plate and positioned with respect to said air introducing means to control the amount of air introduced within the chamber in accordance with movement of the throttle plate.

3. An air/fuel mixing arrangement for an internal combustion engine comprising:

a fuel storage container;

a rotatably mounted hollow shaft oriented to have an open lower end positioned within said container;

an impeller secured to an upper end of the shaft for rotation therewith, said impeller including a plurality of blades radially disposed with respect to the shaft in proximity to radially arranged openings provided in the shaft;

a chamber for housing said impeller;

means for introducing air within the chamber, said means being oriented to cause the air to be directed towards the impeller blades;

an adapter joined to said internal combustion engine;

a throttle plate positioned within an aperture in said adapter, said throttle plate being selectively movable to vary the effective opening of said aperture;

passage means connecting the chamber and the aperture whereby in response to the positioning of the throttle to open said aperture, air and fuel are drawn towards the impeller, mixed within the chamber, and transported to said engine via the passage means and the adapter;

a fuel line connected from the fuel storage container to a passage within said adapter, said passage being oriented to bypass the throttle plate to thereby permit fuel to be introduced directly from said container to the engine via the fuel line, said fuel line including a constriction through which said fuel passes; and means positioned intermediate the constriction and the engine for introducing air to fuel passing through said line.

4. An arrangement as set forth in claim 3, further comprising:

valve means operatively related to the passage within the adapter for controlling the flow of fuel through said line to the engine.

5. An arrangement as set forth in claim 3, further comprising:

means for introducing pressurized air to the interior of said hollow shaft intermediate its ends to atomize fuel which is drawn from the lower end of the shaft towards the upper end.

6. An arrangement as set forth in claim 5, further comprising:

valve means operatively related to said throttle plate and positioned with respect to said air introducing means to control the amount of air introduced within the chamber in accordance with movement of the throttle plate.

7. An arrangement as set forth in claim 5, further comprising:

valve means operatively related to the passage within the adapter for controlling the flow of fuel through said line to the engine.

8. An arrangement as set forth in claim 5, further comprising:

an additional movable throttle plate operatively related to said first-mentioned throttle plate and positioned within a further aperture in said adapter, said passage means connecting the chamber and each of the apertures;

an additional fuel line connected from the fuel storage container to a further passage within said adapter, said further passage being oriented to bypass the additional throttle plate, said additional fuel line including a constriction through which fuel passes; and means for introducing air to said additional fuel line intermediate its constriction and the engine.

9. An arrangement as set forth in claim 8, further comprising:

additional valve means operatively related to said further passage within the adapter for controlling the flow of fuel through said additional line to the engine.

* * * * *